US005465317A

United States Patent [19]

Epstein

[11] Patent Number: 5,465,317

[45] Date of Patent: Nov. 7, 1995

[54] SPEECH RECOGNITION SYSTEM WITH IMPROVED REJECTION OF WORDS AND SOUNDS NOT IN THE SYSTEM VOCABULARY

[75] Inventor: Edward A. Epstein, Putnam Valley, N.Y.

[73] Assignee: International Business Machines Corporation, Armonk, N.Y.

[21] Appl. No.: 62,972

[22] Filed: May 18, 1993

[51] Int. Cl.[6] ..... G10L 5/06

[52] U.S. Cl. ..... 395/2.45; 395/2.6; 395/2.65

[58] Field of Search ..... 395/2.42, 2.45, 395/2.47, 2.6, 2.65

[56] References Cited

U.S. PATENT DOCUMENTS

| | | | |
|---|---|---|---|
| 4,052,568 | 10/1977 | Jankowsi | 179/15 |
| 4,759,068 | 1/1988 | Bahl et al. | 381/43 |
| 4,955,056 | 9/1990 | Stentiford | 381/43 |
| 4,977,599 | 12/1990 | Bahl et al. | 381/43 |
| 4,980,918 | 12/1990 | Bahl et al. | 381/43 |
| 5,182,773 | 1/1993 | Bahl et al. | 381/41 |
| 5,195,167 | 3/1993 | Bahl et al. | 395/2 |
| 5,197,113 | 3/1993 | Mumolo | 395/2 |
| 5,280,562 | 1/1994 | Bahl et al. | 395/2 |
| 5,369,728 | 11/1994 | Kosaka | 395/2.63 |

FOREIGN PATENT DOCUMENTS

| | | | |
|---|---|---|---|
| 0241163A1 | 3/1987 | European Pat. Off. | G10L 5/06 |
| 0314908A2 | 9/1988 | European Pat. Off. | G10L 5/06 |
| 0523347A2 | 5/1992 | European Pat. Off. | G10L 5/06 |

OTHER PUBLICATIONS

Bahl, L. R.., et al. "Vector Quantization Procedure For Speech Recognition Systems Using Discrete Parameter Phoneme–Based Markov Word Models." *IBM Technical Disclosure Bulletin*, vol. 32, No. 7, Dec. 1989, pp. 320 and 321.

Jelinek, F. "Continuous Speech Recognition by Statisical Methods." *Proceedings of the IEEE*, vol. 64, No. 4, Apr. 1976, pp. 532–556.

*Primary Examiner*—Allen R. MacDonald
*Assistant Examiner*—Thomas J. Onka
*Attorney, Agent, or Firm*—Marc D. Schechter; Robert P. Tassinari, Jr.

[57] ABSTRACT

A speech recognizer that selects a command model for a current sound if the best match score for the current sound exceeds its corresponding threshold score. The threshold score is assigned a confidence score based on the best match score and recognition threshold of a prior sound. When the best match score for the current sound exceeds a "poor" confidence score but is less than a "good" confidence score: (a) the word corresponding to the acoustic model having the best match score is accepted as highly likely to correspond to the measured sound if the previously recognized word was accepted as having a high likelihood of corresponding to the previous sound; (b) the word corresponding to the acoustic model having the best match score is rejected as highly unlikely to correspond to the measured sound if the previously recognized word was rejected as having a low likelihood of corresponding to the previous sound; or (c) if there is sufficient intervening silence between a previously rejected word and the current word, then the current word is also accepted as having a high likelihood of corresponding to the measured current sound.

20 Claims, 4 Drawing Sheets

FIG. 1
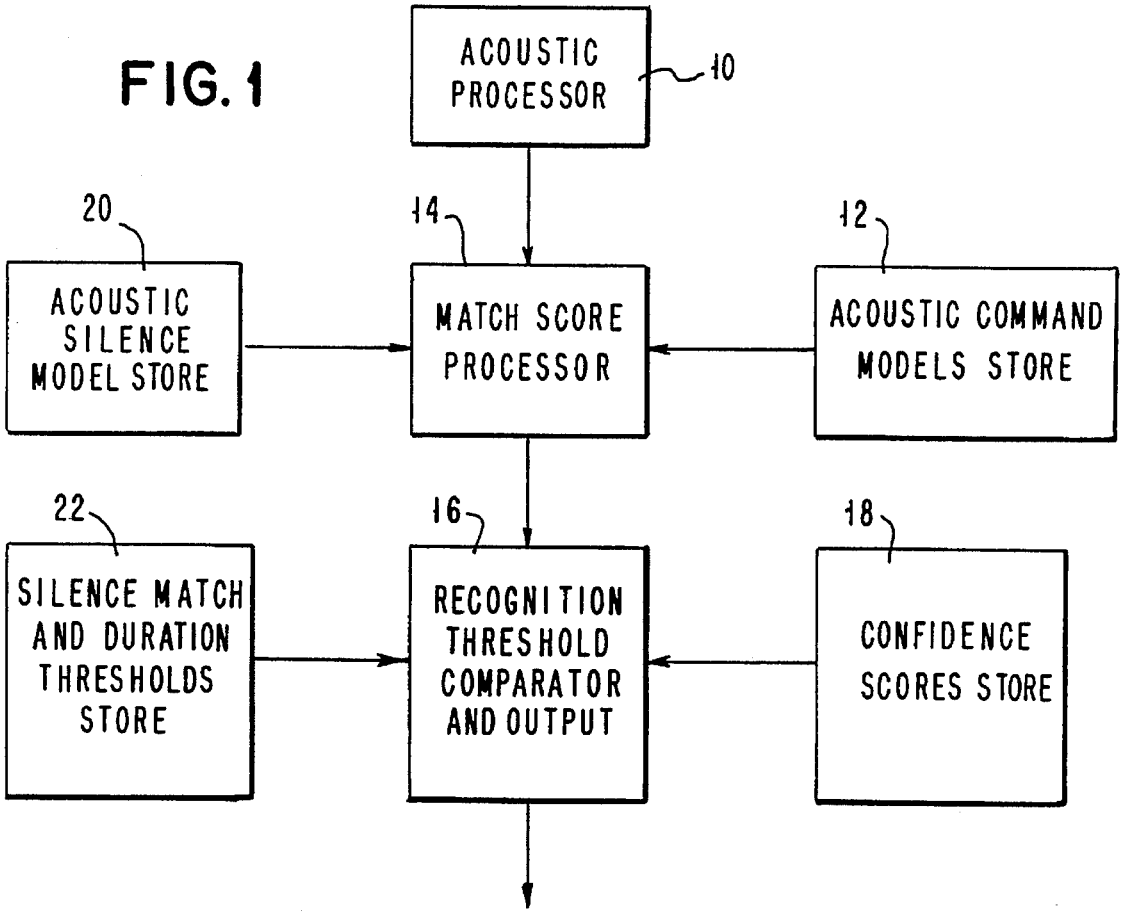
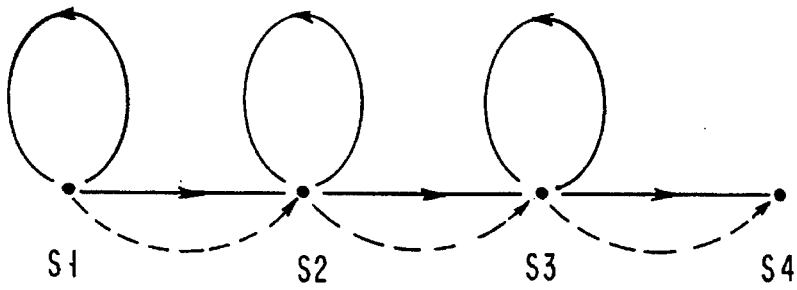
FIG. 2

SPEECH RECOGNITION SYSTEM WITH IMPROVED REJECTION OF WORDS AND SOUNDS NOT IN THE SYSTEM VOCABULARY

BACKGROUND OF THE INVENTION

The invention relates to computer speech recognition, particularly to the recognition of spoken computer commands. When a spoken command is recognized, the computer performs one or more functions associated with the command.

In general, a speech recognition apparatus consists of an acoustic processor and a stores set of acoustic models. The acoustic processor measures sound features of an utterance. Each acoustic model represents the acoustic features of an utterance of one or more words associated with the model. The sound features of the utterance are compared to each acoustic model to produce a match score. The match score for an utterance and an acoustic model is an estimate of the closeness of the sound features of the utterance to the acoustic model.

The word or words associated with the acoustic model having the best match score may be selected as the recognition result. Alternatively, the acoustic match score may be combined with other match scores, such as additional acoustic match scores and language model match scores. The word or words associated with the acoustic model or models having the best combined match score may be selected as the recognition result.

For command and control applications, the speech recognition apparatus preferably recognizes an uttered command, and the computer system then immediately executes the command to perform a function associated with the recognized command. For this purpose, the command associated with the acoustic model having the best match score may be selected as the recognition result.

A serious problem with such systems, however, is that inadvertent sounds such as coughs, sighs, or spoken words not intended for recognition can be misrecognized as valid commands. The computer system then immediately executes the misrecognized commands to perform the associated functions with unintended consequences.

SUMMARY OF THE INVENTION

It is an object of the invention to provide a speech recognition apparatus and method which has a high likelihood of rejecting acoustic matches to inadvertent sounds or words spoken but not intended for the speech recognizer.

It is another object of the invention to provide a speech recognition apparatus and method which identifies the acoustic model which is best matched to a sound, and which has a high likelihood of rejecting the best matched acoustic model if the sound is inadvertent or not intended for the speech recognizer, but which has a high likelihood of accepting the best matched acoustic model if the sound is a word or words intended for recognition.

A speech recognition apparatus according to the invention comprises an acoustic processor for measuring the value of at least one feature of each of a sequence of at least two sounds. The acoustic processor measures the value of the feature of each sound during each of a series of successive time intervals to produce a series of feature signals representing the feature values of the sound. Means are also provided for storing a set of acoustic command models. Each acoustic command model represents one or more series of acoustic feature values representing an utterance of a command associated with the acoustic command model.

A match score processor generates a match score for each sound and each of one or more acoustic command models from the set of acoustic command models. Each match score comprises an estimate of the closeness of a match between the acoustic command model and a series of feature signals corresponding to the sound. Means are provided for outputting a recognition signal corresponding to the command model having the best match score for a current sound if the best match score for the current sound is better than a recognition threshold score for the current sound. The recognition threshold for the current sound comprises (a) a first confidence score if the best match score for a prior sound was better than a recognition threshold for that prior sound, or (b) a second confidence score better than the first confidence score if the best match score for a prior sound was worse than the recognition threshold for that prior sound.

Preferably, the prior sound occurs immediately prior to the current sound.

A speech recognition apparatus according to the invention may further comprise means for storing at least one acoustic silence model representing one or more series of acoustic feature values representing the absence of a spoken utterance. The match score processor also generates a match score for each sound and the acoustic silence model. Each silence match score comprises an estimate of the closeness of a match between the acoustic silence model and a series of feature signals corresponding to the sound.

In this aspect of the invention, the recognition threshold for the current sound comprises the first confidence score (a1) if the match score for the prior sound and the acoustic silence model is better than a silence match threshold, and if the prior sound has a duration exceeding a silence duration threshold, or (a2) if the match score for the prior sound and the acoustic silence model is better than the silence match threshold, and if the prior sound has a duration less than the silence duration threshold, and if the best match score for the next prior sound and an acoustic command model was better than a recognition threshold for that next prior sound, or (a3) if the match score for the prior sound and the acoustic silence model is worse than the silence match threshold, and if the best match score for the prior sound and an acoustic command model was better than a recognition threshold for that prior sound.

The recognition threshold for the current sound comprises the second confidence score better than the first confidence score (b1) if the match score for the prior sound and the acoustic silence model is better than the silence match threshold, and if the prior sound has a duration less than the silence duration threshold, and if the best match score for the next prior sound and an acoustic command model was worse than the recognition threshold for that next prior sound, or (b2) if the match score for the prior sound and the acoustic silence model is worse than the silence match threshold, and if the best match score for the prior sound and an acoustic command model was worse than the recognition threshold for that prior sound.

The recognition signal may be, for example, a command signal for calling a program associated with the command. In one aspect of the invention, the output means comprises a display, and the output means displays one or more words corresponding to the command model having the best match score for a current sound if the best match score for the current sound is better than the recognition threshold score for the current sound.

In another aspect of the invention, the output means outputs an unrecognizable-sound indication signal if the best match score for the current sound is worse than the recognition threshold score for the current sound. For example, the output means may display an unrecognizable-sound indicator if the best match score for the current sound is worse than the recognition threshold score for the current sound. The unrecognizable-sound indicator may comprise, for example, one or more question marks.

The acoustic processor in the speech recognition apparatus according to the invention may comprise, in part, a microphone. Each sound may be, for example, a vocal sound, and each command may comprise at least one word.

Thus, according to the invention, acoustic match scores generally fall into three categories. When the best match score is better than a "good" confidence score, the word or words corresponding to the acoustic model having the best match score almost always correspond to the measured sounds. On the other hand, when the best match score is worse than a "poor" confidence score, the word corresponding to the acoustic model having the best match score almost never corresponds to the measured sounds. When the best match score is better than the "poor" confidence score but is worse than the "good" confidence score, the word corresponding to the acoustic model having the best match score has a high likelihood of corresponding to the measured sound when the previously recognized word was accepted as having a high likelihood of corresponding to the previous sound. When the best match score is better than the "poor" confidence score but is worse than the "good" confidence score, the word corresponding to the acoustic model having the best match score has a low likelihood of corresponding to the measured sound when the previously recognized word was rejected as having a low likelihood of corresponding to the previous sound. However, if there is sufficient intervening silence between a previously rejected word and the current word having the best match score better than the "poor" confidence score but worse than the "good" confidence score, then the current word is also accepted as having a high likelihood of corresponding to the measured current sound.

By adopting the confidence scores according to the invention, a speech recognition apparatus and method has a high likelihood of rejecting acoustic matches to inadvertent sounds or words spoken but not intended for the speech recognizer. That is, by adopting the confidence scores according to the invention, a speech recognition apparatus and method which identifies the acoustic model which is best matched to a sound has a high likelihood of rejecting the best matched acoustic model if the sound is inadvertent or not intended for the speech recognizer, and has a high likelihood of accepting the best matched acoustic model if the sound is a word or words intended for the speech recognizer.

BRIEF DESCRIPTION OF THE DRAWING

FIG. 1 is a block diagram of an example of a speech recognition apparatus according to the invention.

FIG. 2 schematically shows an example of an acoustic command model.

DESCRIPTION OF THE PREFERRED EMBODIMENTS

Figure 3:
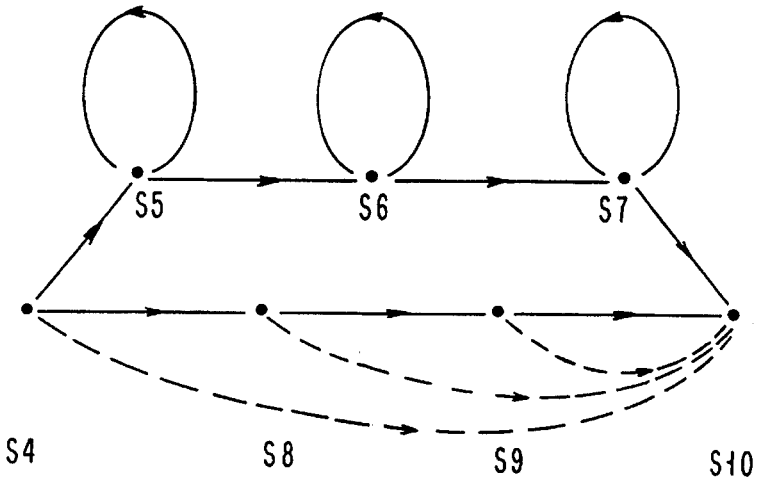
FIG. 3 schematically shows an example of an acoustic silence model.

Referring to FIG. 1, the speech recognition apparatus according to the invention comprises an acoustic processor 10 for measuring the value of at least one feature of each of a sequence of at least two sounds. The acoustic processor 10 measures the value of the feature of each sound during each of a series of successive time intervals to produce a series of feature signals representing the feature values of the sound.

As described in more detail, below, the acoustic processor may, for example, measure the amplitude of each sound in one or more frequency bands during each of a series of ten-millisecond time intervals to produce a series of feature vector signals representing the amplitude values of the sound. If desired, the feature vector signals may be quantized by replacing each feature vector signal with a prototype vector signal, from a set of prototype vector signals, which is best matched to the feature vector signal. Each prototype vector signal has a label identifier, and so in this case the acoustic processor produces a series of label signals representing the feature values of the sound.

The speech recognition apparatus further comprises an acoustic command models store 12 for storing a set of acoustic command models. Each acoustic command model represents one or more series of acoustic feature values representing an utterance of a command associated with the acoustic command model.

The stored acoustic command models may be, for example, Markov models or other dynamic programming models. The parameters of the acoustic command models may be estimated from a known uttered training text by, for example, smoothing parameters obtained by the forward-backward algorithm. (See, for example, F. Jelinek. "Continuous Speech Recognition By Statistical Methods." *Proceedings of the IEEE*, Vol. 64, No. 4, April 1976, pages 532–556.)

Preferably, each acoustic command model represents a command spoken in isolation (that is, independent of the context of prior and subsequent utterances). Context-independent acoustic command models can be produced, for example, either manually from models of phonemes, or automatically, for example, by the method described by Lalit R. Bahl et al in U.S. Pat. No. 4,759,068 entitled "Constructing Markov Models of Words From Multiple Utterances", or by any other known method of generating context-independent models.

Alternatively, context-dependent models may be produced from context-independent models by grouping utterances of a command into context-dependent categories. A context can be, for example, manually selected, or automatically selected by tagging each feature signal corresponding to a command with its context, and by grouping the feature signals according to their context to optimize a selected evaluation function. (See, for example, Lalit R. Bahl et al, "Apparatus and Method of Grouping Utterances of a Phoneme into Context-Dependent Categories Based on Sound- Similarity for Automatic Speech Recognition." U.S. Pat. No. 5,195,167.)

FIG. 2 schematically shows an example of a hypothetical acoustic command model. In this example, the acoustic command model comprises four states S1, S2, S3, and S4 illustrated in FIG. 2 as dots. The model starts at the initial state S1 and terminates at the final state S4. The dashed null transitions correspond to no acoustic feature signal output by the acoustic processor 10. To each solid line transition, there corresponds an output probability distribution over either feature vector signals or label signals produced by the acoustic processor 10. For each state of the model, there corresponds a probability distribution over the transitions out of that state.

Returning to FIG. 1, the speech recognition apparatus further comprises a match score processor 14 for generating a match score for each sound and each of one or more acoustic command models from the set of acoustic command models in acoustic command models store 12. Each match score comprises an estimate of the closeness of a match between the acoustic command model and a series of feature signals from acoustic processor 10 corresponding to the sound.

A recognition threshold comparator and output 16 outputs a recognition signal corresponding to the command model from acoustic command models store 12 having the best match score for a current sound if the best match score for the current sound is better than a recognition threshold score for the current sound. The recognition threshold for the current sound comprises a first confidence score from confidence scores store 18 if the best match score for a prior sound was better than a recognition threshold for that prior sound. The recognition threshold for the current sound comprises a second confidence score from confidence scores store 18, better than the first confidence score, if the best match score for a prior sound was worse than the recognition threshold for that prior sound.

The speech recognition apparatus may further comprise an acoustic silence model store 20 for storing at least one acoustic silence model representing one or more series of acoustic feature values representing the absence of a spoken utterance. The acoustic silence model may be, for example, a Markov model or other dynamic programming model. The parameters of the acoustic silence model may be estimated from a known uttered training text by, for example, smoothing parameters obtained by the forward-backward algorithm, in the same manner as for the acoustic command models.

FIG. 3 schematically shows an example of an acoustic silence model. The model starts in the initial state S4 and terminates in the final state S10. The dashed null transitions correspond to no acoustic feature signal output. To each solid line transition there corresponds an output probability distribution over the feature signals (for example, feature vector signals or label signals) produced by the acoustic processor 10. For each state S4 through S10, there corresponds a probability distribution over the transitions out of that state.

Returning to FIG. 1, the match score processor 14 generates a match score for each sound and the acoustic silence model in acoustic silence model store 20. Each match score with the acoustic silence model comprises an estimate of the closeness of a match between the acoustic silence model and a series of feature signals corresponding to the sound.

In this variation of the invention, the recognition threshold utilized by recognition threshold comparator and output 16 comprises the first confidence score if the match score for the prior sound and the acoustic silence model is better than a silence match threshold obtained from silence match and duration thresholds store 22, and if the prior sound has a duration exceeding a silence duration threshold stored in silence match and duration thresholds store 22. Alternatively, the recognition threshold for the current sound comprises the first confidence score if the match score for the prior sound and the acoustic silence model is better than the silence match threshold, and if the prior sound has a duration less than the silence duration threshold, and if the best match score for the next prior sound and an acoustic command model was better than a recognition threshold for that next prior sound. Finally, the recognition threshold for the current sound comprises the first confidence score if the match score for the prior sound and the acoustic silence model is worse than the silence match threshold, and if the best match score for the prior sound and an acoustic command model was better than a recognition threshold for that prior sound.

In this embodiment of the invention, the recognition threshold for the current sound comprises the second confidence score better than the first confidence score from confidence scores store 18 if the match score from match score processor 18 for the prior sound and the acoustic silence model is better than the silence match threshold, and if the prior sound has a duration less than the silence duration threshold, and if the best match score for the next prior sound and an acoustic command model was worse than the recognition threshold for that next prior sound. Alternatively, the recognition threshold for the current sound comprises the second confidence score better than the first confidence score if the match score for the prior sound and the acoustic silence model is worse than the silence match threshold, and if the best match score for the prior sound and an acoustic command model was worse than the recognition threshold for that prior sound.

Figure 4:
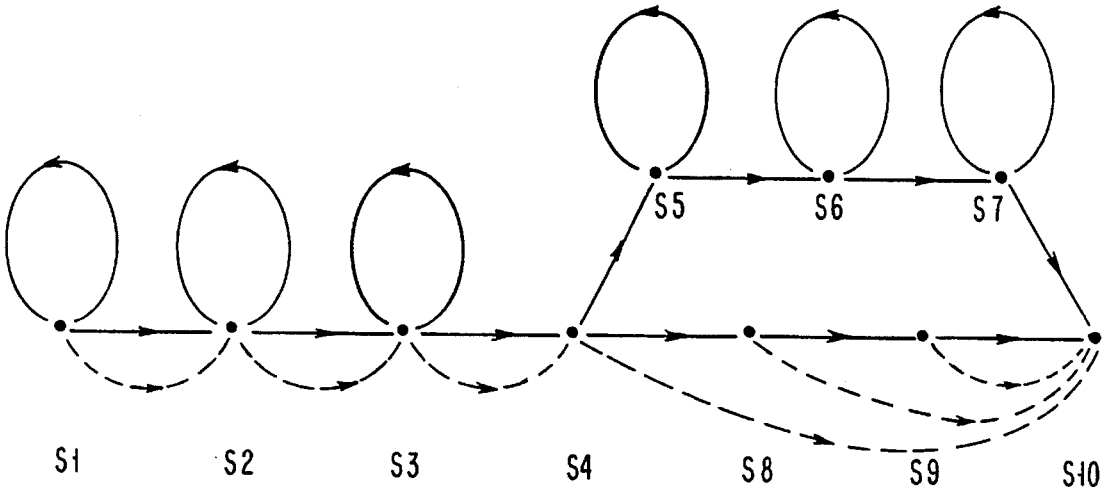
FIG. 4 schematically shows an example of the acoustic silence model of FIG. 3 concatenated onto the end of the acoustic command model of FIG. 2.

In order to generate a match score for each sound and each of one or more acoustic command models from the set of acoustic command models in acoustic command models store 12, and in order to generate a match score for each sound and the acoustic silence model in acoustic silence model store 20, the acoustic silence model of FIG. 3 may be concatenated onto the end of the acoustic command model of FIG. 2, as shown in FIG. 4. The combined model starts in the initial state S1, and terminates in the final state S10.

Figure 5:
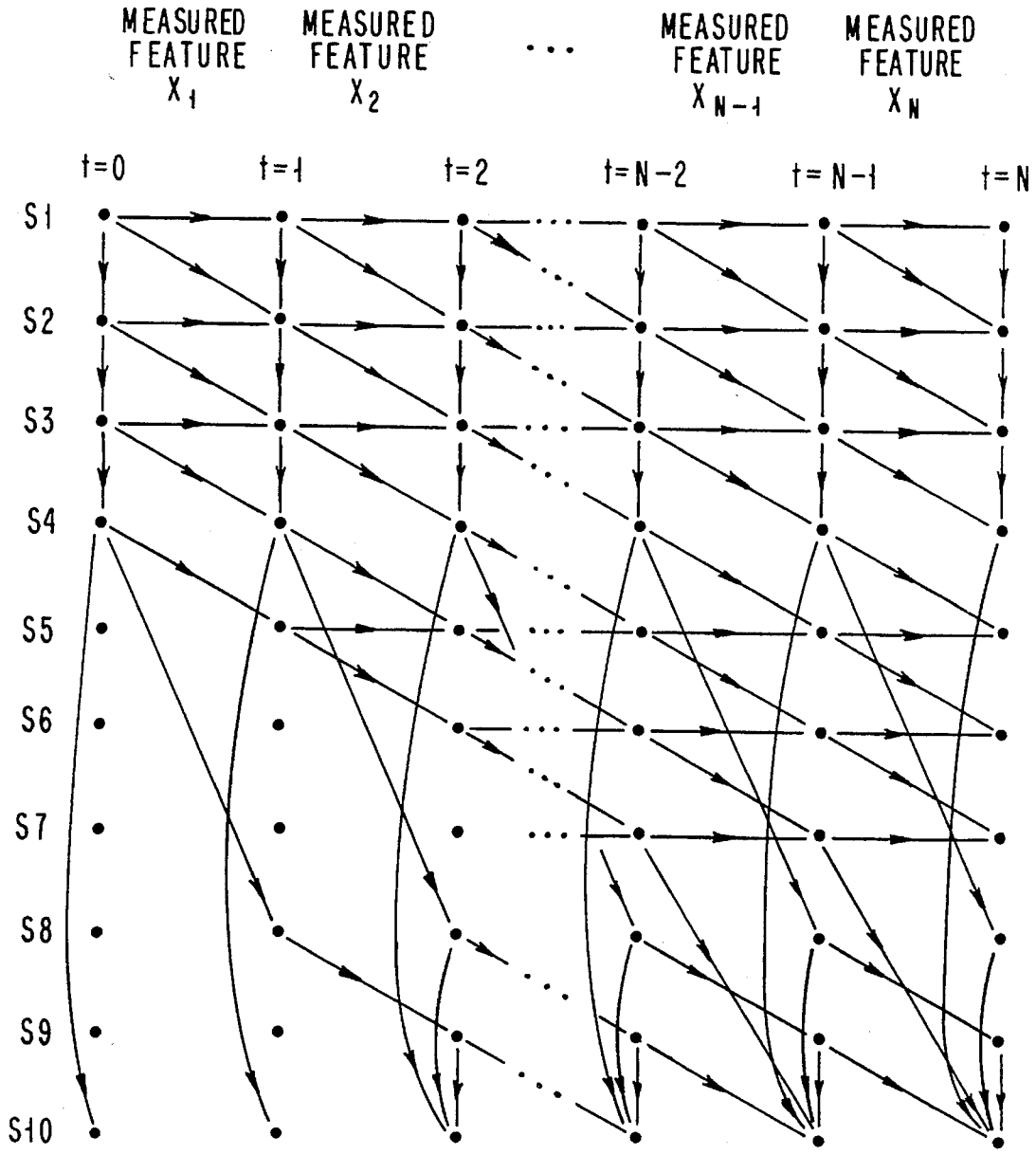
FIG. 5 schematically shows the states and possible transitions between states for the combined acoustic model of FIG. 4 at each of a number of times t.

The states S1 through S10 and the allowable transitions between the states for the combined acoustic model of FIG. 4 at each of a number of times t are schematically shown in FIG. 5. For each time interval between t=n−1 and t=n, the acoustic processor produces a feature signal $X_n$.

For each state of the combined model shown in FIG. 4, the conditional probability $P(s_t=S\sigma|X_1 \ldots X_t)$ that state $s_t$ equals state $S\sigma$ at time t given the occurrence of feature signals $X_1$ through $X_t$ produced by the acoustic processor 10 at times 1 through t, respectively, is obtained by Equations 1 through 10.

$$P(s_t = S1|X_1 \ldots X_t) = [P(s_{t-1} = S1)\, P(s_t = S1|s_{t-1} = S1)\, P(X_t|s_t = S1, s_{t-1} = S1)] \quad [1]$$

-continued

[2]
$$P(s_t = S2|X_1 \ldots X_t) = [P(s_{t-1} = S1)\, P(s_t = S2|s_{t-1} = S1)\, P(X_t|s_t = S2, s_{t-1} = S1)] + P(s_t = S1)\, P(s_t = S2|s_t = S1) + [P(s_{t-1} = S2)\, P(s_t = S2|s_{t-1} = S2)\, P(X_t|s_t = S2, s_{t-1} = S2)]$$

[3]
$$P(s_t = S3|X_1 \ldots X_t) = [P(s_{t-1} = S2)\, P(s_t = S3|s_{t-1} = S2)\, P(X_t|s_t = S3, s_{t-1} = S2)] + P(s_t = S2)\, P(s_t = S3|s_t = S2) + [P(s_{t-1} = S3)\, P(s_t = S3|s_{t-1} = S3)\, P(X_t|s_t = S3, s_{t-1} = S3)]$$

[4]
$$P(s_t = S4|X_1 \ldots X_t) = [P(s_{t-1} = S3)\, P(s_t = S4|s_{t-1} = S3)\, P(X_t|s_t = S4, s_{t-1} = S3)] + P(s_t = S3)\, P(s_t = S4|s_t = S3)$$

[5]
$$P(s_t = S5|X_1 \ldots X_t) = [P(s_{t-1} = S4)\, P(s_t = S5|s_{t-1} = S4)\, P(X_t|s_t = S5, s_{t-1} = S4)] + [P(s_{t-1} = S5)\, P(s_t = S5|s_{t-1} = S5)\, P(X_t|s_t = S5, s_{t-1} = S5)]$$

[6]
$$P(s_t = S6|X_1 \ldots X_t) = [P(s_{t-1} = S5)\, P(s_t = S6|s_{t-1} = S5)\, P(X_t|s_t = S6, s_{t-1} = S5)] + [P(s_{t-1} = S6)\, P(s_t = S6|s_{t-1} = S6)\, P(X_t|s_t = S6, s_{t-1} = S6)]$$

[7]
$$P(s_t = S7|X_1 \ldots X_t) = [P(s_{t-1} = S6)\, P(s_t = S7|s_{t-1} = S6)\, P(X_t|s_t = S7, s_{t-1} = S6)] + [P(s_{t-1} = S7)\, P(s_t = S7|s_{t-1} = S7)\, P(X_t|s_t = S7, s_{t-1} = S7)]$$

[8]
$$P(s_t = S8|X_1 \ldots X_t) = [P(s_{t-1} = S4)\, P(s_t = S8|s_{t-1} = S4)\, P(X_t|s_t = S8, s_{t-1} = S4)]$$

[9]
$$P(s_t = S9|X_1 \ldots X_t) = [P(s_{t-1} = S8)\, P(s_t = S9|s_{t-1} = S8)\, P(X_t|s_t = S9, s_{t-1} = S8)]$$

[10]
$$P(s_t = S10|X_1 \ldots X_t) = P(s_t = S4)\, P(s_t = S10|s_t = S4) + P(s_t = S8)\, P(s_t = S10|s_t = S8) + P(s_t = S9)\, P(s_t = S10|s_t = S9) + [P(s_{t-1} = S7)\, P(s_t = S10|s_{t-1} = S7)\, P(X_t|s_t = S10, s_{t-1} = S7)] + [P(s_{t-1} = S9)\, P(s_t = S10|s_{t-1} = S9)\, P(X_t|s_t = S10, s_{t-1} = S9)]$$

In order to normalize the conditional state probabilities to account for the different numbers of feature signals ($X_1 \ldots X_t$) at different times t, a normalized state output score Q for a state σ at time t can be given by Equation 11.

[11]
$$Q(S\sigma,t) = \frac{P(s_t = S\sigma|X_1 \ldots X_t)}{\prod_{i=1}^{t} P(X_i)}$$

Estimated values for the conditional probabilities $P(s_t = S\sigma|X_1 \ldots X_t)$ of the states (in this example, states S1 through S10) can be obtained from Equations 1 through 10 by using the values of the transition probability parameters and the output probability parameters of the acoustic command models and acoustic silence model.

Estimated values for the normalized state output score Q can be obtained from Equation 11 by estimating the probability $P(X_1)$ of each observed feature signal $X_i$ as the product of the conditional probability $P(X_i|X_{i-1})$ of feature signal $X_i$ given the immediately prior occurrence of feature signal $X_{i-1}$, multiplied by the probability $P(X_{i-1})$ of occurrence of the feature signal $X_{i-1}$. The value of $P(X_i|X_{i-1})\, P(X_{i-1})$ for all feature signals $X_i$ and $X_{i-1}$ may be estimated by counting the occurrences of feature signals generated from a training text according to Equation 12.

[12]
$$P(X_i|X_{i-1})P(X_{i-1}) = \frac{N(X_i, X_{i-1})}{N(X_{i-1})} \frac{N(X_{i-1})}{N} = \frac{N(X_i, X_{i-1})}{N}$$

In Equation 12, $N(X_i, X_{i-1})$ is the number of occurrences of the feature signal $X_i$ immediately preceded by the feature signal $X_{i-1}$ generated by the utterance of the training script, and N is the total number of feature signals generated by the utterance of the training script.

From Equation 11, above, normalized state output scores W(S4, t) and Q(S10, t) can be obtained for states S4 and S10 of the combined model of FIG. 4. State S4 is the last state of the command model and is the first state of the silence model. State S10 is the last state of the silence model.

In one example of the invention, a match score for a sound and the acoustic silence model at time t may be given by the ratio of the normalized state output score Q[S ,t] for state S10 divided by the normalized state output score Q[S4, t] for state S4 as shown in Equation 13.

[13]
$$\text{Silence Start Match Score} = \frac{Q[S10,t]}{Q[S4,t]}$$

The time $t=t_{start}$ at which the match score for the sound and the acoustic silence model (Equation 13) first exceeds a silence match threshold may be considered to be the beginning of an interval of silence. The silence match threshold is a tuning parameter which may be adjusted by the user. A silence match threshold of $10^{15}$ has been found to produce good results.

The end of the interval of silence may, for example, by determined by evaluating the ratio of the normalized state output score Q[S10,t] for state S10 at time t divided by the maximum value obtained for the normalized state output score $Q_{max}$[S10, $t_{start} \ldots t$] for state S10 over time intervals $t_{start}$ through t.

[14]
$$\text{Silence End Match Score} = \frac{Q[S10,t]}{Q_{max}[S10, t_{start} \ldots t]}$$

The time $t=t_{end}$ at which the value of the silence end match score of Equation 14 first falls below the value of a silence end threshold may be considered to be the end of the interval of silence. The value of the silence end threshold is a tuning parameter which can be adjusted by the user. A value of $10^{-25}$ has been found to provide good results.

If the match score for the sound and the acoustic silence model as given by Equation 13 is better than the silence match threshold, then the silence is considered to have started the first time $t_{start}$ at which the ratio of Equation 13 exceeded the silence match threshold. The silence is considered to have ended at the first time $t_{end}$ at which the ratio of Equation 14 is less than the associated tuning parameter. The duration of the silence is then $(t_{end}-t_{start})$.

For the purpose of deciding whether the recognition threshold should be the first confidence score or the second confidence score, the silence duration threshold stored in silence match and duration thresholds store 22 is a tuning parameter which is adjustable by the user. A silence duration threshold of, for example, 25 centiseconds has been found to provide good results.

The match score for each sound and an acoustic command model corresponding to states S1 through S4 of FIGS. 2 and 4 may be obtained as follows. If the ratio of Equation 13 does not exceed the silence match threshold prior to the time $t_{end}$, the match score for each sound and the acoustic command model corresponding to states S1 through S4 of FIGS. 2 and 4 may be given by the maximum normalized state output score $Q_{max}$ [S10, $t'_{end} \ldots t_{end}$] for state S10 over time intervals $t'_{end}$ through $t_{end}$, where $t'_{end}$ is the end of the preceding sound or silence, and where $t_{end}$ is the end of the current sound or silence. Alternatively, the match score for each sound and the acoustic command model may be given by the sum of the normalized state output scores Q[S10,t) for state S10 over time intervals $t'_{end}$ through $t_{end}$.

However, if the ratio of Equation 13 exceeds the silence match threshold prior to the time $t_{end}$, then the match score for the sound and the acoustic command model may be given by the normalized state output score Q[S4, $t_{start}$] for states S4 at time $t_{start}$. Alternatively, the match score for each sound and the acoustic command model may be given by the sum of the normalized state output scores Q[S4,t] for state S4 over time intervals $t'_{end}$ through $t_{start}$.

The first confidence score and the second confidence score for the recognition treshold are tuning parameters which may be adjusted by the user. The first and second confidence scores may be generated, for example, as follows.

A training script comprising in-vocabulary command words represented by stored acoustic command models, and also comprising out-of-vocabulary words which are not represented by stored acoustic command models is uttered by one or more speakers. Using the speech recognition apparatus according to the invention, but without a recognition threshold, a series of recognized words are generated as being best matched to the uttered, known training script. Each word or command output by the speech recognition apparatus has an associated match score.

By comparing the command words in the known training script with the recognized words output by the speech recognition apparatus, correctly recognized words and misrecognized words can be identified. The first confidence score may, for example, be the best match score which is worse than the match scores of 99% to 100% of the correctly recognized words. The second confidence score may be, for example, the worst match score which is better than the match scores of, for example, 99 to 100% of the misrecognized words in the training script.

The recognition signal which is output by the recognition threshold comparator and output 16 may comprise a command signal for calling a program associated with the command. For example, the command signal may simulate the manual entry of keystrokes corresponding to a command. Alternatively, the command signal may be an application program interface call.

The recognition threshold comparator and output 16 may comprise a display, such as a cathode ray tube, a liquid crystal display, or a printer. The recognition threshold comparator and output 16 may display one or more words corresponding to the command model having the best match score for a current sound if the best match score for the current sound is better than the recognition threshold score for the current sound.

The output means 16 may optionally output an unrecognizable-sound signal if the best match score for the current sound is worse than the recognition threshold score for the current sound. For example, the output 16 may display an unrecognizable-sound indicator if the best match score for the current sound is worse than the recognition threshold score for the current sound. The unrecognizable-sound indicator may comprise one or more displayed question marks.

Each sound measured by the acoustic processor 10 may be a vocal sound or some other sound. Each command associated with an acoustic command model preferably comprises at least one word.

At the beginning of a speech recognition session, the recognition threshold may be initialized at either the first confidence score or the second confidence score. Preferably, however, the recognition threshold for the current sound is initialized at the first confidence score at the beginning of a speech recognition session.

The speech recognition apparatus according to the present invention may be used with any existing speech recognizer, such as the IBM Speech Server Series (trademark) product. The match score processor 14 and the recognition threshold comparator and output 16 may be, for example, suitably programmed special purpose or general purpose digital processors. The acoustic command models store 12, the confidence scores store 18, the acoustic silence model store 20, and the silence match and duration thresholds store 22 may comprise, for example, electronic readable computer memory.

Figure 6:
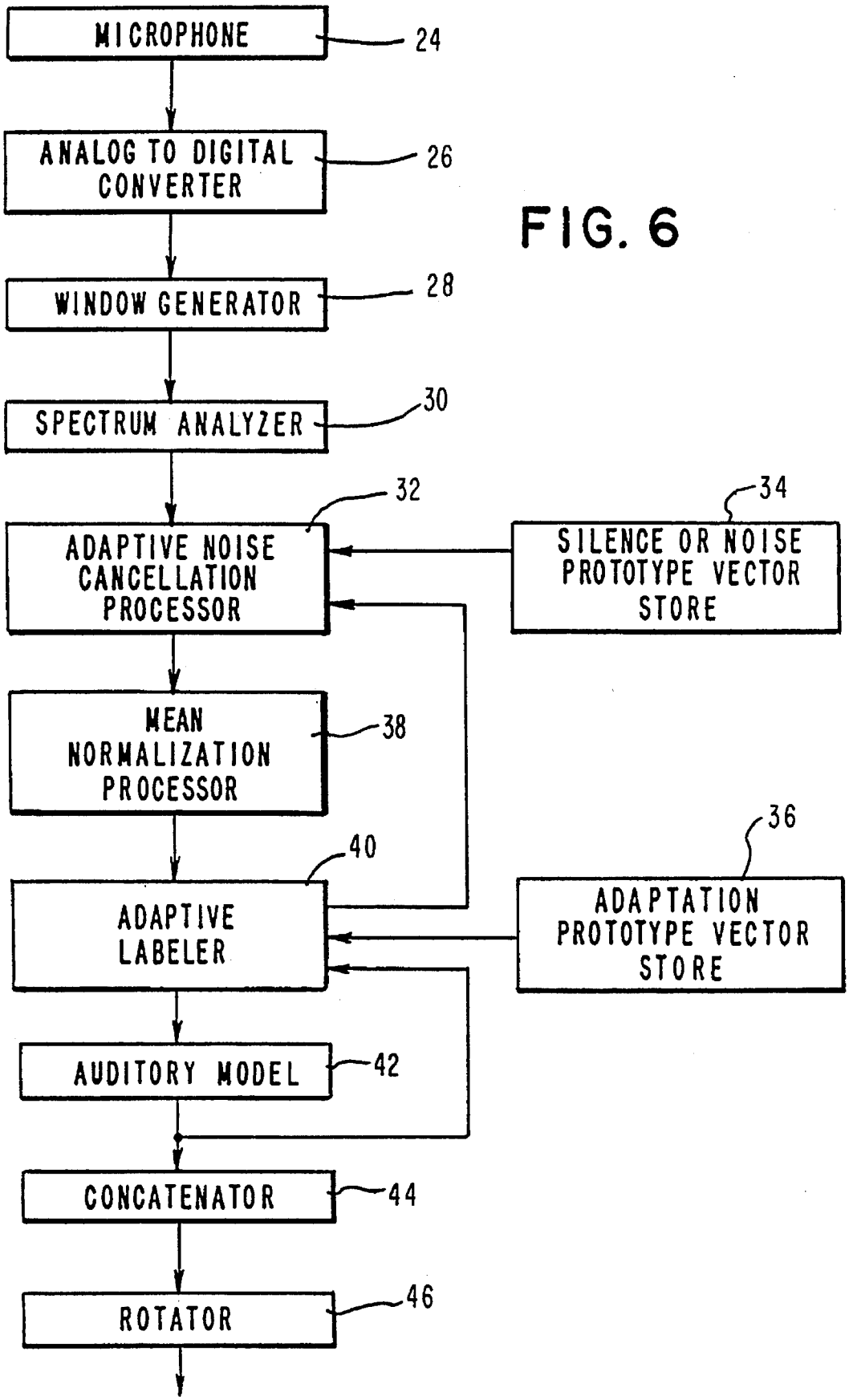
FIG. 6 is a block diagram of an example of the acoustic processor of FIG. 1.

One example of the acoustic processor 10 of FIG. 3 is shown in FIG. 6. The acoustic processor comprises a microphone 24 for generating an analog electrical signal corresponding to the utterance. The analog electrical signal from microphone 24 is converted to a digital electrical signal by analog to digital converter 26. For this purpose, the analog signal may be sampled, for example, at a rate of twenty kilohertz by the analog to digital converter 26.

A window generator 28 obtains, for example, a twenty millisecond duration sample of the digital signal from analog to digital converter 26 every ten milliseconds (one centisecond). Each twenty millisecond sample of the digital signal is analyzed by spectrum analyzer 30 in order to obtain the amplitude of the digital signal sample in each of, for example, twenty frequency bands. Preferably, spectrum analyzer 30 also generates a twenty-first dimension signal representing the total amplitude or total power of the twenty millisecond digital signal sample. The spectrum analyzer 30 may be, for example, a fast Fourier transform processor. Alternatively, it may be a bank of twenty band pass filters.

The twenty-one dimension vector signals produced by spectrum analyzer 30 may be adapted to remove background noise by an adaptive noise cancellation processor 32. Noise cancellation processor 32 subtracts a noise vector N(t) from the feature vector F(t) input into the noise cancellation processor to produce an output feature vector F'(t). The noise cancellation processor 32 adapts to changing noise levels by periodically updating the noise vector N(t) whenever the prior feature vector F(t−1) is identified as noise or silence. The noise vector N(t) is updated according to the formula $$N(t)=\frac{N(t-1)+k[F(t-1)-Fp(t-1)]}{(1+k)}, \quad [15]$$

where N(t) is the noise vector at time t, N(t−1) is the noise vector at time (t−1), k is a fixed parameter of the adaptive noise cancellation model, F(t−1) is the feature vector input into the noise cancellation processor 32 at time (t−1) and which represents noise or silence, and Fp(t−1) is one silence or noise prototype vector, from store 34, closest to feature vector F(t−1).

The prior feature vector F(t−1) is recognized as noise or silence if either (a) the total energy of the vector is below a threshold, or (b) the closest prototype vector is adaptation prototype vector store 36 to the feature vector is a prototype representing noise or silence. For the purpose of the analysis of the total energy of the feature vector, the threshold may be, for example, the fifth percentile of all feature vectors (corresponding to both speech and silence) produced in the two seconds prior to the feature vector being evaluated.

After noise cancellation, the feature vector F'(t) is normalized to adjust for variations in the loudness of the input speech by short term mean normalization processor 38. Normalization processor 38 normalizes the twenty-one dimension feature vector F'(t) to produce a twenty dimension normalized feature vector X(t). The twenty-first dimension of the feature vector F'(t), representing the total amplitude or total power, is discarded. Each component i of the normalized feature vector X(t) at time t may, for example, be given by the equation $$X_i(t)=F'_i(t)-Z(t) \quad (16)$$

in the logarithmic domain, where $F'_1(t)$ is the i-th component of the unnormalized vector at time t, and where Z(t) is a weighted mean of the components of F'(t) and Z(t−1) according to Equations 17 and 18:

$$Z(t)=0.9Z(t-1)+0.1M(t) \quad (17)$$

and where $$M(t)=\frac{1}{20}\sum_i F'_i(t) \quad [18]$$

The normalized twenty dimension feature vector X(t) may be further processed by an adaptive labeler 40 to adapt to variations in pronunciation of speech sounds. An adapted twenty dimension feature vector X'(t) is generated by subtracting a twenty dimension adaptation vector A(t) from the twenty dimension feature vector X(t) provided to the input of the adaptive labeler 40. The adaptation vector A(t) at time t may, for example, be given by the formula $$A(t)=\frac{A(t-1)+k[X(t-1)-Xp(t-1)]}{(1+k)}, \quad [19]$$

where k is a fixed parameter of the adaptive labeling model, X(t−1) is the normalized twenty dimension vector input to the adaptive labeler 40 at time (t−1), Xp(t−1) is the adaptation prototype vector (from adaptation prototype store 36) closest to the twenty dimension feature vector X(t−1) at time (t−1), and A(t−1) is the adaptation vector at time (t−1).

The twenty dimension adapted feature vector signal X'(t) from the adaptive labeler 40 is preferably provided to an auditory model 42. Auditory model 42 may, for example, provide a model of how the human auditory system perceives sound signals. An example of an auditory model is described in U.S. Pat. No. 4,980,918 to Bahl et al entitled "Speech Recognition System with Efficient Storage and Rapid Assembly of Phonological Graphs".

Preferably, according to the present invention, for each frequency band i of the adapted feature vector signal X'(t) at time t, the auditory model 42 calculates a new parameter $E_i(t)$ according to Equations 20 and 21:

$$E_i(t)=K_1+K_2(X'_i(t))(N_i(t-1)) \quad (20)$$

where $$N_i(t)=K_3\times N_i(t-1)-E_i(t-1) \quad (21)$$

and where $K_1$, $K_2$, and $K_3$ are fixed parameters of the auditory model.

For each centisecond time interval, the output of the auditory model 42 is a modified twenty dimension feature vector signal. This feature vector is augmented by a twenty-first dimension having a value equal to the square root of the sum of the squares of the values of the other twenty dimensions.

For each centisecond time interval, a concatenator 44 preferably concatenates nine twenty-one dimension feature vectors representing the one current centisecond time interval, the four preceding centisecond time intervals, and the four following centisecond time intervals to form a single spliced vector of 189 dimensions. Each 189 dimension spliced vector is preferably multiplied in a rotator 46 by a rotation matrix to rotate the spliced vector and to reduce the spliced vector to fifty dimensions.

The rotation matrix used in rotator 46 may be obtained, for example, by classifying into M classes a set of 189 dimension spliced vectors obtained during a training session. The covariance matrix for all of the spliced vectors in the training set is multiplied by the inverse of the within-class covariance matrix for all of the spliced vectors in all M classes. The first fifty eigenvectors of the resulting matrix form the rotation matrix. (See, for example, "Vector Quantization Procedure For Speech Recognition Systems Using Discrete Parameter Phoneme-Based Markov Word Models" by L. R. Bahl, et al, *IBM Technical Disclosure Bulletin*, Volume 32, No. 7, December 1989, pages 320 and 321.)

Window generator 28, spectrum analyzer 3, adaptive noise cancellation processor 32, short term mean normalization processor 38, adaptive labeler 40, auditory model 42, concatenator 44, and rotator 46, may be suitably programmed special purpose or general purpose digital signal processors. Prototype stores 34 and 36 may be electronic computer memory of the types discussed above.

The prototype vectors in prototype store 24 may be obtained, for example, by clustering feature vector signals from a training set into a plurality of clusters, and then calculating the mean and standard deviation for each cluster to form the parameter values of the prototype vector. When the training script comprises a series of word-segment models (forming a model of a series of words), and each word-segment model comprises a series of elementary models having specified locations in the word-segment models, the feature vector signals may be clustered by specifying that each cluster corresponds to a single elementary model in a single location in a single word-segment model. Such a method is described in more detail in U.S. patent application Ser. No. 730,714, filed on Jul. 16, 1991, entitled "Fast Algorithm for Deriving Acoustic Prototypes for Automatic Speech Recognition." Alternatively, all acoustic feature vectors generated by the utterance of a training text and which correspond to a given elementary model may be clustered by K-means euclidean clustering or K-means Gaussian clustering, or both. Such a method is described, for example, by Bahl et al in U.S. Pat. No. 5,182,773 entitled "Speaker-Independent Label Coding Apparatus".

I claim:

1. A speech recognition apparatus comprising:

an acoustic processor for measuring the value of at least one feature of each of a sequence of at least two sounds, said acoustic processor measuring the value of the feature of each sound during each of a series of successive time intervals to produce a series of feature signals representing the feature values of the sound; means for storing a set of acoustic command models, each acoustic command model representing one or more series of acoustic feature values representing an utterance of a command associated with the acoustic command model.

a match score processor for generating a match score for each sound and each of one or more acoustic command models from the set of acoustic command models, each match score comprising an estimate of the closeness of a match between the acoustic command model and a series of feature signals corresponding to the sound; and means for outputting a recognition signal corresponding to the acoustic command model having a best match score for a current sound if the best match score for the current sound is greater than a recognition threshold score for the current sound, the recognition threshold score for the current sound is equal to (a) a first confidence score if the best match score for a prior sound was greater than a recognition threshold for the prior sound, or (b) a second confidence score greater than the first confidence score if the best match score for the prior sound was less than the recognition threshold for the prior sound.

2. A speech recognition apparatus as claimed in claim 1, characterized in that the prior sound is contiguous with the current sound.

3. A speech recognition apparatus as claimed in claim 2, characterized in that:

the apparatus further comprises means for storing at least one acoustic silence model representing one or more series of acoustic feature values representing the absence of a spoken utterance;

the match score processor generates a match score for each sound and the acoustic silence model, each match score comprising an estimate of the closeness of a match between the acoustic silence model and a series of feature signals corresponding to the sound; and the recognition threshold score for the current sound is equal to the first confidence score (a1) if the match score for the prior sound and the acoustic silence model is greater than a silence match threshold, and if the prior sound has a duration exceeding a silence duration threshold, or (a2) if the match score for the prior sound and the acoustic silence model is greater than the silence match threshold, and if the prior sound has a duration less than the silence duration threshold, and if the best match score for a second prior sound and an acoustic command model was greater than a recognition threshold for the second prior sound, or (a3) if the match score for the prior sound and the acoustic silence model is less than the silence match threshold, and if the best match score for the prior sound and an acoustic command model was greater than a recognition threshold for the prior sound; or the recognition threshold for the current sound is equal to the second confidence score better than the first confidence score (b1) if the match score for the prior sound and the acoustic silence model is greater than the silence match threshold, and if the prior sound has a duration less than the silence duration threshold, and if the best match score for the second prior sound and an acoustic command model was less than the recognition threshold for the second prior sound, or (b2) if the match score for the prior sound and the acoustic silence model is less than the silence match threshold, and f the best match score for the prior sound and an acoustic command model was less than the recognition threshold for the prior sound.

4. A speech recognition apparatus as claimed in claim 3, characterized in that the recognition signal comprises a command signal for calling a program associated with the command.

5. A speech recognition apparatus as claimed in claim 4, characterized in that:

the output means comprises a display; and the output means displays one or more words corresponding to the command model having the best match score for a current sound if the best match score for the current sound is better than the recognition threshold score for the current sound.

6. A speech recognition apparatus as claimed in claim 5, characterized in that the output means outputs an unrecognizable-sound indication signal if the best match score for the current sound is worse than the recognition threshold score for the current sound.

7. A speech recognition apparatus as claimed in claim 6, characterized in that the output means displays an unrecognizable-sound indicator if the best match score for the current sound is worse than the recognition threshold score for the current sound.

8. A speech recognition apparatus as claimed in claim 7, characterized in that unrecognizable-sound indicator comprises one or more question marks.

9. A speech recognition apparatus as claimed in claim 1, characterized in that the acoustic processor comprises a microphone.

10. A speech recognition apparatus as claimed in claim 1, characterized in that:

each sound comprises a vocal sound; and each command model comprises at least one word.

11. A speech recognition apparatus as claimed in claim 1, characterized in that the acoustic processor is adapted to measure the value of at least one feature of each of a sequence of at least three sounds, wherein the first prior sound is contiguous with the current sound.

12. A speech recognition method comprising the steps of:

measuring the value of at least one feature of each of a sequence of at least two sounds, the value of the feature of each sound being measured during each of a series of successive time intervals to produce a series of feature signals representing the feature values of the sound;

storing a set of acoustic command models, each acoustic command model representing one or more series of acoustic feature values representing an utterance of a command associated with the acoustic command model;

generating a match score for each sound and each of one or more acoustic command models from the set of acoustic command models, each match score comprising an estimate of the closeness of a match between the acoustic command model and a series of feature signals corresponding to the sound; and outputting a recognition signal corresponding to the acoustic command model having a best match score for a current sound if the best match score for the current sound is greater than a recognition threshold score for the current sound, the recognition threshold score for the current sound is equal to a first confidence score if the best match score for a prior sound was greater than a recognition threshold for the prior sound, or (b) a second confidence score greater than the first confidence score if the best match score for the prior sound was less than the recognition threshold for the prior sound.

13. A speech recognition method as claimed in claim 12, characterized in that the prior sound is contiguous with the current sound.

14. A speech recognition method as claimed in claim 13, further comprising the steps of:

storing at least one acoustic silence model representing one or more series of acoustic feature values representing the absence of a spoken utterance;

generating a match score for each sound and the acoustic silence model, each match score comprising an estimate of the closeness of a match between the acoustic silence model and a series of feature signals corresponding to the sound; and characterized in that the recognition threshold score for the current sound is equal to the first confidence score (a1) if the match score for the prior sound and the acoustic silence model is greater than a silence match threshold, and if the prior sound has a duration exceeding a silence duration threshold, or (a2) if the match score for the prior sound and the acoustic silence model is greater than the silence match threshold, and if the prior sound has a duration less than the silence duration threshold, and if the best match score for a second prior sound and an acoustic command model was greater than a recognition threshold for the second prior sound, or (a3) if the match score for the prior sound and the acoustic silence model is less than the silence match threshold, and if the best match score for the prior sound and an acoustic command model was greater than a recognition threshold for the prior sound; or the recognition threshold for the current sound is equal to the second confidence score better than the first confidence score (b1) if the match score for the prior sound and the acoustic silence model is greater than the silence match threshold, and if the prior sound has a duration less than the silence duration threshold, and if the best match score for the second prior sound and an acoustic command model was less than the recognition threshold for the second prior sound, or (b2) if the match score for the prior sound and the acoustic silence model is less than the silence match threshold, and if the best match score for the first prior sound and an acoustic command model was less than the recognition threshold for the prior sound.

15. A speech recognition method as claimed in claim 14, characterized in that the recognition signal comprises a command signal for calling a program associated with the command.

16. A speech recognition method as claimed in claim 15, further comprising the step of displaying one or more words corresponding to the command model having the best match score for a current sound if the best match score for the current sound is better than the recognition threshold score for the current sound.

17. A speech recognition method as claimed in claim 16, further comprising the step of outputting an unrecognizable-sound indication signal if the best match score for the current sound is worse than the recognition threshold score for the current sound.

18. A speech recognition method as claimed in claim 17, further comprising the step of displaying an unrecognizable-sound indicator if the best match score for the current sound is worse than the recognition threshold score for the current sound.

19. A speech recognition method as claimed in claim 18, characterized in that unrecognizable-sound indicator comprises one or more question marks.

20. A speech recognition method as claimed in claim 12, characterized in that:

each sound comprises a vocal sound; and each command model comprises at least one word.

* * * * *